US005884439A

United States Patent [19]

Hess, III et al.

[11] Patent Number: 5,884,439

[45] Date of Patent: Mar. 23, 1999

[54] CONCRETE FORM WITH INTEGRAL DRAIN AND ADJUSTABLE STAKE THEREFOR

[75] Inventors: John Hess, III; Harold Hess, both of Belleville, Ill.

[73] Assignee: Hess Bros., L.L.C., Fairview Heights, Ill.

[21] Appl. No.: 864,931

[22] Filed: May 29, 1997

[51] Int. Cl.[6] ..... F02D 19/00

[52] U.S. Cl. ..... 52/155; 52/169.5; 52/678; 52/684; 52/700; 52/741.11; 52/741.13; 248/188.4; 248/507; 248/508; 249/5

[58] Field of Search ..... 52/155, 169.5, 52/169.13, 294, 741.11, 741.13, 745.21, 678, 684–686, 699, 700, 365, 369; 248/188.4, 507, 508, 87, 88; 249/3–5

[56] References Cited

U.S. PATENT DOCUMENTS

| | | |
|---|---|---|
| 631,317 | 8/1899 | Miller . |
| 954,902 | 4/1910 | Titus . |
| 961,297 | 6/1910 | Jaeger . |
| 994,155 | 6/1911 | Harris . |
| 1,852,673 | 4/1932 | Pilj . |
| 2,347,126 | 4/1944 | Rohrer . |
| 3,017,722 | 1/1962 | Smith . |
| 3,284,973 | 11/1966 | Ames et al. . |
| 3,613,323 | 10/1971 | Hreha . |
| 3,903,704 | 9/1975 | Spiridonov . |
| 4,185,429 | 1/1980 | Mendola . |
| 4,524,678 | 6/1985 | Klebanoff . |
| 4,702,048 | 10/1987 | Millman . |
| 4,757,651 | 7/1988 | Crites . |
| 4,765,106 | 8/1988 | Modrovich . |
| 4,773,195 | 9/1988 | Waller . |
| 4,832,557 | 5/1989 | Jacobsen . |
| 5,120,162 | 6/1992 | Parker . |
| 5,224,799 | 7/1993 | Parker . |
| 5,406,758 | 4/1995 | Baum . |
| 5,586,416 | 12/1996 | Hess, III et al. . |

OTHER PUBLICATIONS

Product Information & Advantages; Form–A–Drain; Certain Teed Corporation; 1994.

*Primary Examiner*—Robert Canfield
*Attorney, Agent, or Firm*—Howell & Haferkamp, L.C.

[57] ABSTRACT

An adjustable concrete form comprises at least one tube and an adjustable stake having a post and a tube cradle. The tube has at least one drainage aperture providing the form with drainage. The adjustable stake is configured for adjustably supporting the tube in spaced-apart relation to an excavation bottom. The post has at least one slender end to facilitate driving the post partially into the excavation bottom. The tube cradle is configured for releasable engagement with the tube to thereby secure the tube relative to the post and to support the tube in spaced-apart relation to the excavation bottom. The tube cradle is adjustably connected to the post so that adjustment of the post relative to the cradle effectuates adjustment of the tube relative to the excavation bottom.

28 Claims, 4 Drawing Sheets

CONCRETE FORM WITH INTEGRAL DRAIN AND ADJUSTABLE STAKE THEREFOR

BACKGROUND OF THE INVENTION

This invention relates generally to footing/foundation forms for the construction of concrete foundations, and more particularly to such forms having integral drainage systems including a plurality of hollow tubes elevated to grade above an excavation bottom and supported at that level by a plurality of stakes.

Typical building practice requires construction of a footing or foundation upon which vertical concrete walls of a structure rest. A typical outer wall may range from 6–12 inches in thickness and the footing upon which the walls rest is typically wider than the wall width and may have a vertical depth (height) of 6–12 inches. Because these foundations are commonly a substantial distance below ground level, accumulation of water with a head of pressure at the footing level is a problem. To prevent this ground water from entering the building through floor or foundation cracks, or through crevices between the foundation and basement floor, good building practice provides a means for removing the undesired ground water. Standard procedures have developed over the years to construct sturdy footings/foundations and to provide a drainage system to remove future unwanted ground water.

The standard procedures include preparing a trench or excavation to the appropriate depth and dimensions to accommodate the footing/foundation forms and drainage system. Next, the inside and outside corner points of the footing/foundation wall are surveyed and a string or chalk line is placed around the intended footing/foundation perimeter. Historically, planks of seasoned wood were arranged along the surveyed line and secured in place by stakes. Because foundation forms are typically a pair of serpentuitous parallel walls, the prior art planks were cut to appropriate lengths using either mitered ends or special corner pieces to maintain the parallel relationship throughout the footing/foundation perimeters. After completing the entire footing/foundation network, concrete was poured between the forms, appropriately screeded, and allowed to set. When the concrete was sufficiently hard (typically the next day), the forms were removed. Once the forms were removed, a certain amount of re-trenching was required to remove accumulated backfill and debris. Then, after re-trenching, an independent drainage system was installed. It was also customary to place gravel or filler stone around and over the drainage system to create a leach field to facilitate proper draining.

Recognizing the costs associated with the highly labor intensive prior art footing/foundation construction techniques (i.e. excavating, installing forms, pouring the footing, removing the forms, re-trenching, constructing the drainage system, laying a gravel leach field, and backfilling the excavation), attempts have been made to minimize these costs. However, many of these attempts have failed to adequately minimize costs because the methods employed required custom designed materials which to a substantial degree offset labor savings with an increase in material costs.

Many of the problems associated with prior art forms were overcome by the footing/foundation form disclosed and claimed in U.S. Pat. No. 5,586,416 (the '416 patent), which is commonly owned by the inventors herein. The disclosure of the '416 patent is incorporated herein by reference.

The footing/foundation form disclosed in the '416 patent has two substantially parallel spaced apart, serpentuitous walls, each wall including a plurality of hollow tubes elevated to grade above an excavation bottom by stake and clip mechanisms with gravel filled between the elevated tubes and the excavation bottom. The tubes are connected end-to-end and include a plurality of holes to enable water accumulating adjacent the footing/foundation to drain into a sewer, dry well, or sump pump. However, unlike other prior art forms having integral drainage means, the tubes of the '416 patent are preferably standard 10-foot PVC round tubes available at many hardware and construction stores or are easily adapted from commonly available PVC tubes. The stakes of the '416 patent are pieces of reinforcing bar (or other steel rods which are readily available) and the clips are also manufactured from inexpensive materials.

Once the tubes of the '416 patent are elevated to grade, the clips are frictionally and resiliently engaged to the stakes and the tubes to secure the tubes to grade. After the form is constructed, further adjustments in the elevation of the tubes is accomplished by driving the stakes further into, or pulling them out of, the ground.

SUMMARY OF THE INVENTION

The present invention represents an improvement over the stake and footing/foundation form of the '416 patent. In general, an adjustable concrete form of the present invention comprises a plurality of hollow tubes and a plurality of adjustable stakes. Each of the hollow tubes has at least one drainage aperture providing the form with integral drainage. The adjustable stakes are configured for adjustably supporting the tubes in spaced-apart relation to an excavation bottom. Each adjustable stake is an integral structure formed of two pieces: a post, and a tube cradle connected to the post. The post of each adjustable stake has at least one slender end to facilitate driving the post partially into the excavation bottom. The tube cradle of each adjustable stake is configured for releasable engagement with one of the tubes to thereby secure the tube relative to the post and to support the tube in spaced-apart relation to the excavation bottom. The cradle is adjustably connected to the post so that adjustment of the cradle relative to the post effectuates adjustment of the tubes relative to the excavation bottom.

When constructing the adjustable concrete form of the present invention, the first step is to excavate a concrete receiving area. Next, the tubes are elevated approximately to grade above the excavation bottom and the posts of each adjustable stake are driven partially into the excavation bottom. Then, the tubes are secured to the stakes by the cradles so that the tubes are supported in spaced-apart relation to the excavation bottom. Finally, the heights of the tubes are adjusted relative to the excavation bottom to bring the tubes substantially to grade by adjusting the adjustable stakes. Preferably, the heights of the tubes are adjusted relative to the excavation bottom by altering the relative relationships of the posts and the cradles.

Therefore, the present invention provides an adjustable concrete form which can be easily and precisely adjusted relative to an excavation bottom, even following initial assembly, without compromising the integrity of the assembled form.

While the principal advantages and features of the present invention have been described above, a more complete and thorough understanding and appreciation for the invention may be attained by referring to the drawings and description of the preferred embodiments which follow.

BRIEF DESCRIPTION OF THE DRAWINGS

Reference characters in the written specification indicate corresponding parts throughout the several views of the drawings.

DETAILED DESCRIPTION OF THE PREFERRED EMBODIMENT

Figure 1:
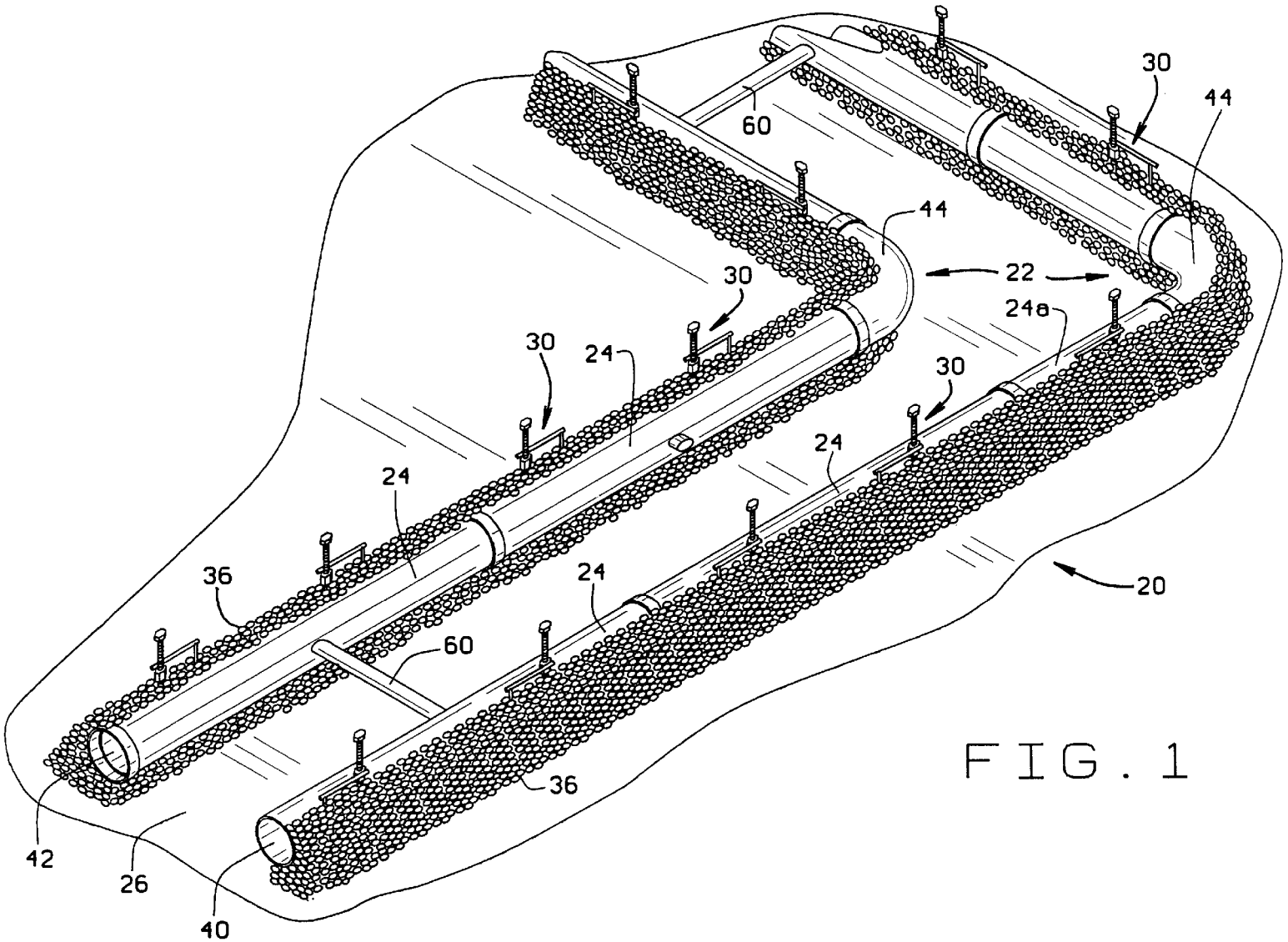
FIG. 1 is an isometric view of a footing/foundation form of the present invention shown with gravel filled between the form and an excavation bottom.
Figure 2:
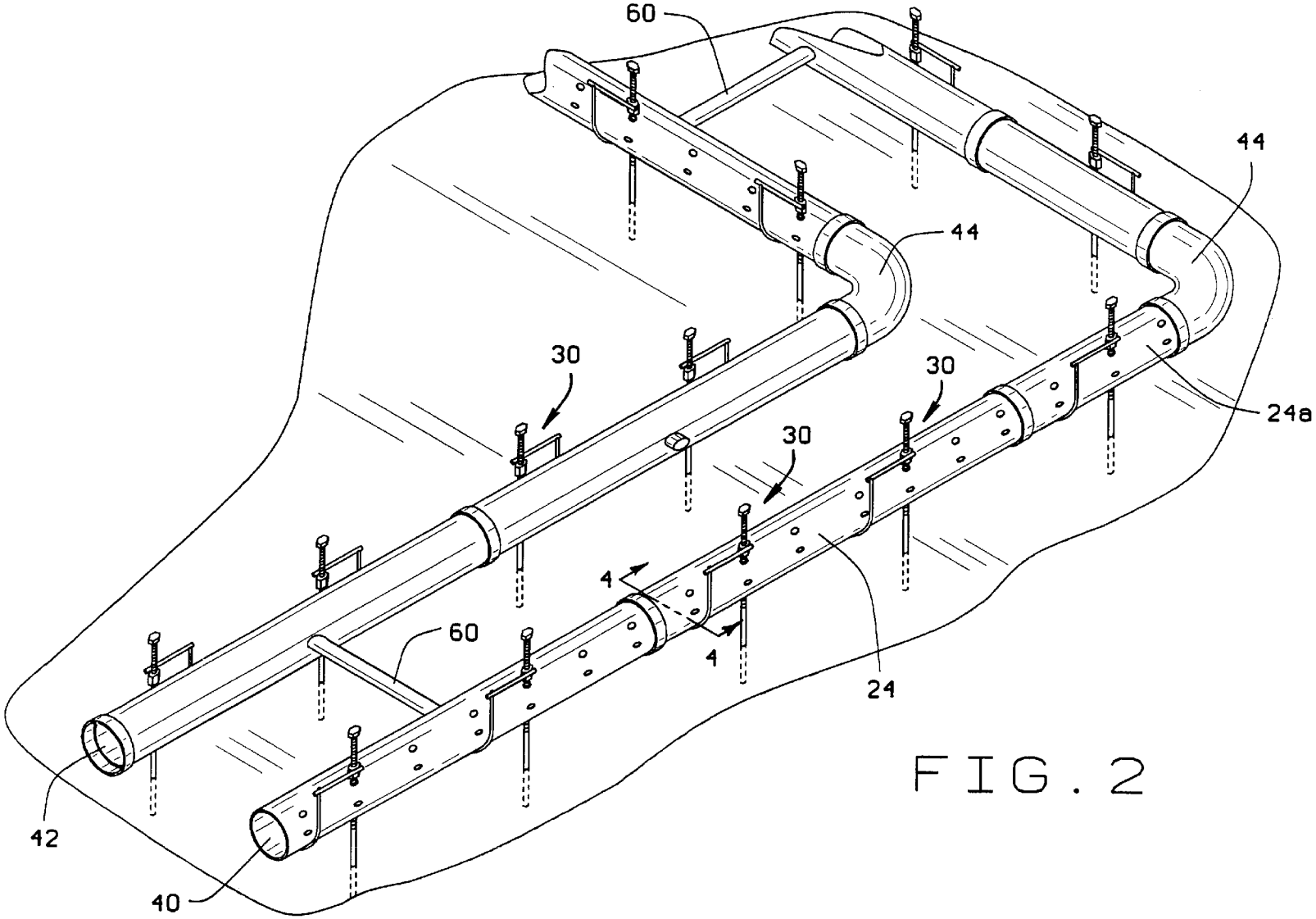
FIG. 2 is an isometric view of the footing/foundation form of FIG. 1 with the gravel fill removed to better illustrate the adjustable stake.
Figure 3:
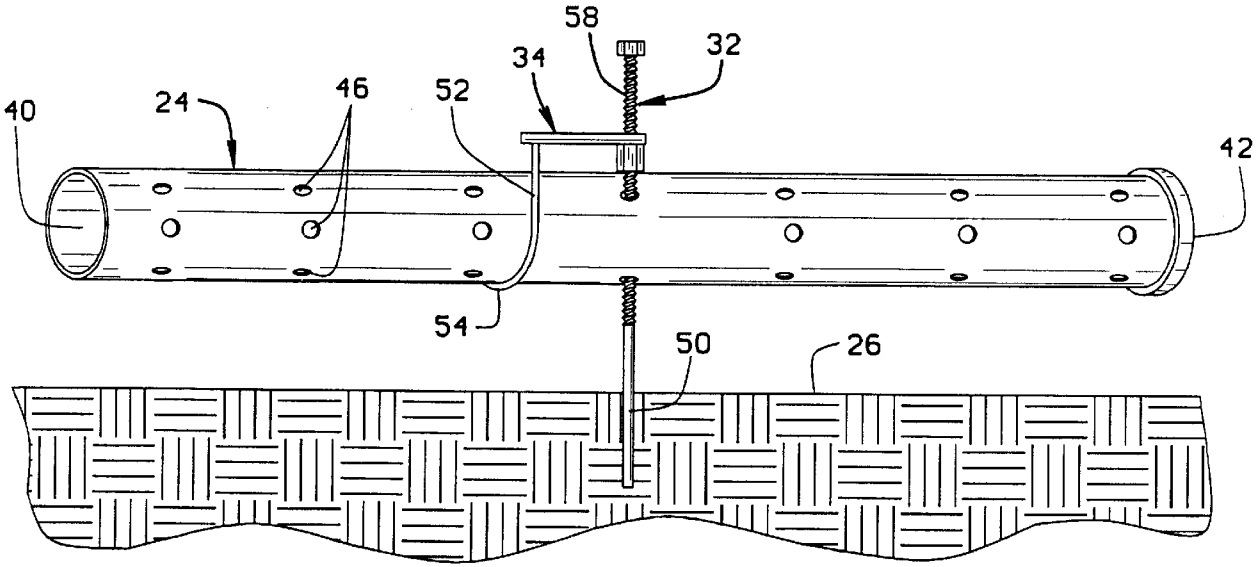
FIG. 3 is a side elevational view of one tube of the present invention showing the adjustable stake in a snap-fit engagement with the tube.
Figure 4:
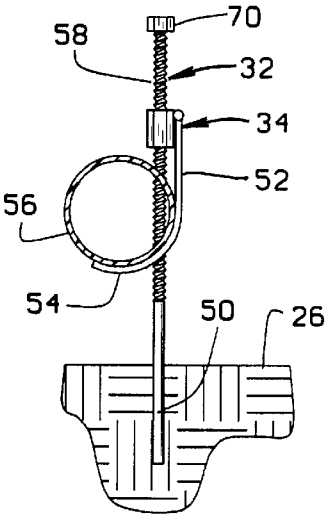
FIG. 4 is a cross-sectional view taken along the plane of line 4—4 in FIG. 2 showing the adjustable stake in a snap-fit engagement with the tube.

Referring to FIGS. 1 through 4, an adjustable concrete form of the present invention is indicated generally by the reference numeral 20. The form 20 includes two substantially parallel, spaced apart, serpentuitous walls 22 for retaining concrete poured therebetween. Each wall includes a plurality of hollow tubes 24 linked end to end. As best shown in FIG. 2, the tubes are secured in spaced relation to an excavation bottom 26 by a plurality of adjustable stakes 30. Each adjustable stake 30 is comprised of a post 32 and a tube cradle 34. The post 32 and the tube cradle 34 are an integral structure formed of two pieces: a post and a cradle connected to the post. Preferably, gravel 36 is filled beneath the elevated tubes 24 (see FIG. 1).

The disclosure of commonly owned U.S. Pat. No. 5,586,416, is incorporated herein by reference. In the preferred embodiment of the present invention, the tubes 24 are 10-foot polyethylene tubes having a 4 inch diameter. However, polyvinyl chloride (PVC) tubes and tubes made of other materials could be used as well without departing from the scope of the present invention. Although 10-foot tubes having a 4 inch diameter are preferred, tubes having other lengths and other diameters could be used without departing from the scope of the present invention.

While being transported to the excavation site, and while being stored at the site prior to installation, the tubes 24 may be exposed to sunlight for extended periods of time. In order to avoid softening or other damage to the tubes 24 caused by extended exposure to sunlight, in the preferred embodiment at least an exterior surface of the tubes 24 is white, or another reflective color, so that sunlight is reflected away from the tubes 24.

The tubes 24 each include a male end 40 and a female end 42 to enable convenient end-to-end connection of multiple tubes. Various shaped elbows 44 (i.e. 30°, 45°, 60°, 90°, etc.) are provided to enable the end-to-end connection of the tubes in a serpentuitous path. The elbows 44 preferably include two female ends which allow any tube 24 to be cut precisely where a change in wall direction is desired and the cut tube will conveniently mate with any elbow 44. Tube 24*a* in FIGS. 1 and 2 illustrates a tube cut to meet design specifications which conveniently mates with the 90° elbow 44.

In the preferred embodiment, each tube includes three longitudinal rows of holes 46 (see FIG. 3) arranged at approximately 30°, 90°, and 150° (viewed from the male end). The holes 46 are preferably ⅝ inches in diameter and spaced 5 inches center-to-center. As illustrated in FIGS. 1 and 2, the holes 46 face away from the footing/foundation allowing liquid therearound to enter the tubes 24 thereby providing the form 20 with integral drainage. Drain tubes (not shown) are connected periodically to the tubes 24 providing a fluid conduit to a sewer or sump pump thereby enabling liquid adjacent the footing/foundation to be removed therefrom.

The preferred embodiment uses gravel 36 between the elevated tubes 24 and the excavation bottom 26 such that both the tubes 24 and the gravel 36 engage and form the concrete poured between walls 22. The gravel is preferably filled to grade (as shown in FIG. 1) level with the top of the tubes 24 thereby providing a leach field for the longitudinal rows of holes 46 and enabling liquid adjacent the footing/foundation to drain through the tubes 24. It is understood that filler stone, rock, or another suitable material may be used in place of (or in combination with) the gravel 36 without departing from the scope of this invention.

The term "tube" is used in a broad sense to include an elongated member that will function as a conduit for water as in a drainage system. It may be of round, rectilinear, or other suitable cross-section. It is also to be understood that the term "excavation" as used herein may be a hole, trench, or other preparation of an earthen surface for receipt of a footing/foundation. Further, while the preferred embodiment uses a pair of spaced apart, serpentuitous walls 22, it is understood that a single wall 22 (constructed as described above) may be employed without departing from the spirit of this invention. Moreover, to minimize the risk of termites and the like, the tubes 24, elbows 44, posts 32, and tube cradles 34 are preferably constructed of non-degradable material.

Each post 32 has at least one slender end 50 to facilitate driving the post partially into the excavation bottom 26. Preferably, the post 32 is cut from steel rod commonly available in the construction field, but could be constructed of other rigid materials. The post 32 is inserted through one 30° hole and its corresponding 150° hole of the tube 24. Each tube cradle 34 is configured for releasable engagement with the tube 24 to thereby secure the tube relative to the post 32 and to support the tube 24 in spaced-apart relation to the excavation bottom 26.

Each tube cradle 34 is moveable relative to the tube 24 between locked and unlocked positions. When in the locked position (see FIGS. 3 and 4), the cradle 34 is releasably engaged with the tube 24 in a manner to secure the tube 24 relative to the post 32 and to support the tube 24 in spaced-apart relation to the excavation bottom 26. When the cradle 34 is moved to the unlocked position, the cradle 34 disengages the tube 24 so that the tube 24 is permitted to move freely relative to the post 32.

The tube cradle 34 includes a handle portion 48 and a member 52. The member 52 is configured for resilient engagement with an exterior surface 56 of the tube 24 when the cradle 34 is in the locked position. The member 52 includes a hook portion 54 at its distal end dimensioned to receive a portion of the exterior surface of the tube in a releasable, snap-fit engagement when the cradle 34 is in the locked position. Preferably, the member 52 itself is somewhat resilient to facilitate engagement of the member 52 with the tube 24 as the cradle 34 is moved from the unlocked to the locked position. Also preferably, the tube 24 itself is somewhat resilient to further facilitate engagement of the member 52 with the tube 24 as the cradle 34 is moved from the unlocked to the locked position. The degree of resiliency of the member 52 may be selected depending on the rigidity of the tube 24.

Figure 7:
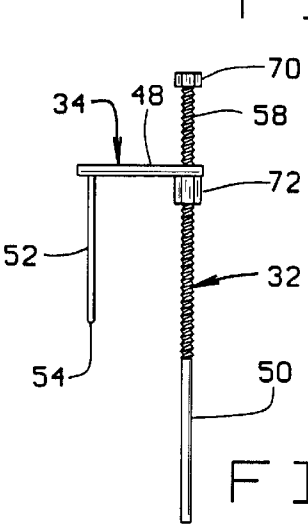
FIG. 7 is an enlarged rear elevational view of the adjustable stake of FIGS. 5 and 6.
Figure 6:
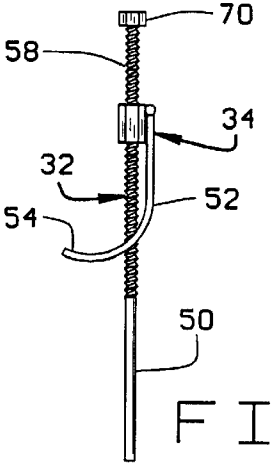
FIG. 6 is an enlarged end view of the adjustable stake of FIG. 5.
Figure 5:
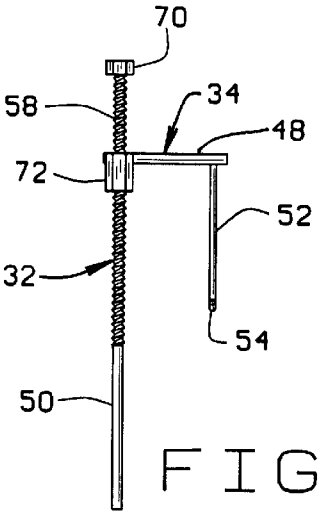
FIG. 5 is an enlarged front elevational view of the adjustable stake of the present invention.

The post 32 and the cradle 34 are adjustably connected to one another so that the position of the cradle 34 can be vertically adjusted relative to the post 32. Preferably, the post 32 and the cradle 34 are connected to one another in a threaded engagement so that rotation of the post 32 and cradle 34 relative to one another effectuates linear advancement of the cradle 34 relative to the post 32, i.e., rotational movement of the post 32 relative to the cradle 34 is translated into linear movement of the cradle 34 relative to the post 32. In the preferred embodiment, the cradle 34 includes an internally threaded hexagonal nut (or sleeve) which circumscribes the post 32. The nut 72 mates with an externally threaded portion 58 of the post 32 (see FIGS. 5 through 7).

As described above, the tube 24 and the cradle 34 are releasably locked relative to one another when the cradle 34 is in the locked position. Therefore, when the cradle 34 is in the locked position, rotation of the post 32 and cradle 34 relative to one another effectuates linear advancement of the both the cradle 34 and the tube 24 relative to the post 32 and relative to the excavation bottom 26, i.e., rotational movement of the post 32 relative to the cradle 34 is translated into linear movement of both the cradle 34 and the tube 24 relative to the post 32 and relative to the excavation bottom 26. The externally threaded portion 58 of the posts 32 also enhances the frictional engagement of the posts 32 with the tubes 24 at the points where the posts 32 are passed through the holes 46.

In the preferred embodiment, the surface of the slender end 50 of each post 32 is smooth and does not include threads or flutes. The smooth surface permits rotational movement of the post 32 relative to the excavation bottom 26 without the post being urged further into, or out of, the ground.

Spacing the longitudinal rows of holes 46 at 30°, 90°, and 150°, as in the preferred embodiment, provides several benefits. This positioning allows the posts 32 to be passed through corresponding 30° and 150° holes and driven into the excavation bottom 26 substantially normal (i.e., at about 90° ) with respect to excavation bottom. Driving the post 32 at substantially 90° minimizes misalignment of the walls 22 as they are elevated off of the excavation bottom which often occurs if the posts are driven at a non-orthogonal angle. This annular hole arrangement also assures that at least some of the holes 46 are on the bottom half of the tube 24. Because gravel 36 is filled below the tubes 24, positioning multiple of the holes 46 on the bottom half of the tube 24 allows fluid to enter the tubes from below thereby enabling expeditious drainage and allows silt/sediment to gravity flow from the tubes which minimizes the possibility of the tubes clogging over time. While not illustrated, the tubes may include holes at 180° to enhance this benefit.

The preferred embodiment describes an excavation having a generally level bottom such that the gravel 36 poured under and around the tubes 24 and elbows 44 rests on substantially the lowest plane of the excavation. However, without departing from the scope or spirit of this invention, the excavation bottom may be tiered or sloped such that the gravel 36 does not rest on the lowest plane thereof.

In operation, the site laborer prepares an excavation 26 to the appropriate depth and dimensions to accommodate the desired footing/foundation form 10. The inside and/or outside corner points of the footing/foundation wall are surveyed and a string or chalk line is placed around the intending footing/foundation perimeter. The tubes 24 are laid such that the holes 46 face generally outward. Elbows 44 are positioned and the tubes 24 are cut where appropriate to conform to the desired footing/foundation shape.

As more fully described in U.S. Pat. No. 5,586,416, which has been incorporated herein by reference, cross-over pipes 60 may be employed. The cross-over pipes 60 provide proper spacing between pairs of tubes 24 when coupled therebetween. Suitable reinforcing bar ("rebar") and supports therefor may also be used in the space between pairs of tubes 24.

Once the tubes and elbows are properly outlined around the footing/foundation perimeter, the posts 32 of the adjustable stakes 30 are placed through the 30° and 150° holes approximately every 5 feet. In the preferred embodiment two stakes 30 are employed for each tube. The posts 32 are driven partially into the ground and the tubes are elevated approximately to grade. A typical footing/foundation is 8 inches deep therefore the tubes and elbows are raised such that they are approximately 8 inches from the excavation bottom measured from their tops. Although the posts 32 are preferably driven partially into the ground, in an alternative method the site laborer pre-drills holes for the posts 32 and then inserts the posts 32 into the holes.

As the tubes 24 and elbows 44 are elevated to grade, the tube cradles 34 are rotated relative to their respective posts 32 to their locked positions with the cradles 34 in a resilient, snap fit engagement with the tubes 24. Thus, with the cradles 34 in their locked position, the tubes 24 and elbows 44 are secured to the posts 32 and are supported above the excavation bottom 26 approximately to grade.

In the preferred embodiment, the heights of the tubes 24 and elbows 44 relative to the excavation bottom 26 can be further adjusted to bring them to grade by altering the relative relationship of the post 32 and the cradle 34. As discussed above, the posts 32 and the cradles 34 are preferably connected to one another in a threaded engagement so that rotation of the posts 32 relative to the cradles 34 effectuates linear advancement of the cradles 34 relative to the posts 32. Thus, when the cradles 34 are in their locked position, rotational movement of the posts 32 is translated into linear movement of both the cradles 34 and the tubes 24 relative to the posts 32 and vertical adjustment of the tubes 24 relative to the excavation bottom 26.

Therefore, in the preferred embodiment, gross vertical adjustment of the tubes 24 and elbows 44 relative to the excavation bottom 26 can be accomplished with the cradles 34 in their unlocked position, and further vertical adjustment (fine adjustment) can be accomplished after the cradles 34 are moved to their locked position by rotating the posts 32. As best shown in FIGS. 3 through 7, each post 32 includes a hexagonal head 70. Both the head 70 and the nut 72 are configured to be gripped between the jaws of conventional wrenches to facilitate turning of the post 32. Although the head 70 and nut 72 are depicted in the Figures as being hexagonal, other polygonal configurations may be used. The head 70 also provides a broader striking surface to facilitate driving of the posts 32 into the excavation bottom 26.

Once the tubes 24 and elbows 44 are properly secured to grade, gravel 36 is filled beneath the elevated tubes and elbows, and extends adjacent the holes 46 flush with the top of the tubes and elbows. At this point, the footing/foundation form is structurally complete. Reinforcing bar and supports may be placed between the parallel spaced apart walls 22 and, finally, concrete is poured between the spaced apart walls 22 thereby forming a footing/foundation having integral drainage and minimizing the draw backs of the prior art techniques.

Figure 8:
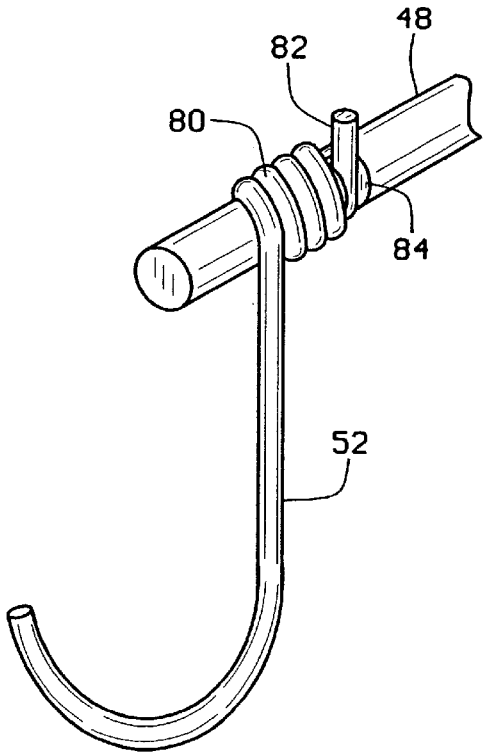
FIG. 8 is an enlarged, fragmented isometric view showing an alternative embodiment of the tube cradle having a coil spring.

In the preferred embodiment, the member 52 of the cradle 34 is rigidly connected to the handle portion 48, such as by being welded. However, FIG. 8 shows an alternative embodiment of the tube cradle 34 wherein the member 52 includes a coil spring 80 at its proximal end. The coil spring 80 is coiled around the handle portion 48 of the cradle 34 and includes an end coil 82. The handle portion 48 includes a groove 84 configured for receiving the end coil 82 in a manner to secure the member 52 to the handle portion 48. The coil spring 80 permits the member 52 to be deflected relative to the handle portion 48 and relative to the post 32. Use of the coil spring 80 adds to the resiliency of the member 52 and facilitates engagement and disengagement of the cradle 34 with the exterior surface 56 of the tube 24.

Figure 9:
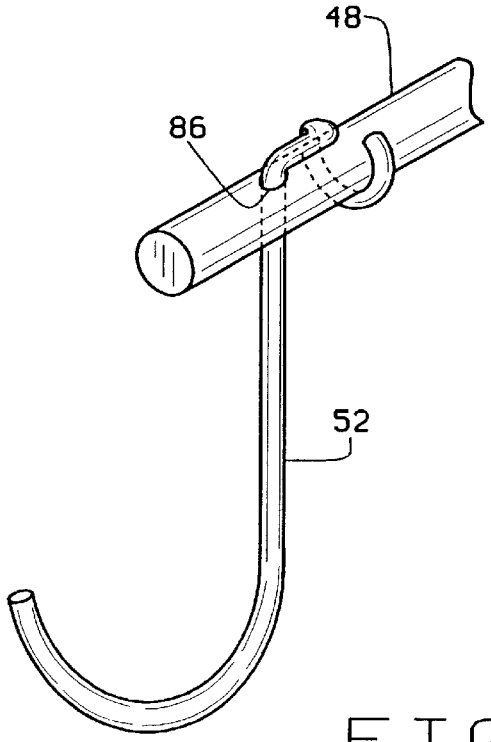
FIG. 9 is an enlarged, fragmented isometric view showing an alternative embodiment of the tube cradle having a resilient member which passes through a hole in a handle portion of the tube cradle.

FIG. 9 shows another alternative embodiment of the tube cradle 34 wherein the handle portion 48 includes a hole 86 which passes therethrough. The proximal end of the member 52 passes through the hole 86 and is then coiled around the handle portion 48 to secure the member 52 thereto.

In the embodiments of the present invention described above, the axial relationship of the posts 32 to the excavation bottom 26 remains substantially fixed while the positions of the tubes 24 and elbows 44 are adjusted relative to the posts 32. However, in another alternative embodiment of the present invention, the axial relationship of the posts to the excavation bottom changes while the relationship of the posts to the tubes and elbows remains fixed. In this alternative embodiment, the nut of the cradle is in a bearing engagement with the post, rather than a threaded engagement, so that the cradle is rotatable relative to the post but not axially movable. In this alternative embodiment, the slender end of the post is threaded (or fluted) so that rotational movement of the post relative to the excavation bottom urges the post further into, or out of, the ground. Thus, in this alternative embodiment, as with the other embodiments described above, a connection between the post and cradle allows rotation of the post relative to the cradle such that rotation of the post relative to the cradle effectuates height adjustment of the tubes and elbows.

In view of the above, it will be seen that improvements over the prior art have been achieved and other advantageous results attained.

As various changes could be made in the above constructions without departing from the scope of the invention, it is intended that all matter contained in the above description or shown in the accompanying drawings shall be interpreted as illustrative and not in a limiting sense. It should be understood that other configurations of the present invention could be constructed, and different uses could be made, without departing from the scope of the invention as set forth in the following claims.

What is claimed is:

1. An adjustable stake for use with a concrete form, the form including at least one hollow tube having at least one drainage aperture providing the form with integral drainage, the adjustable stake comprising:

a post having at least one slender end to facilitate driving the post partially into an excavation bottom; and a tube cradle including a resilient member configured for resilient engagement with the tube to thereby secure the tube relative to the post and to support the tube in spaced-apart relation to the excavation bottom, the post and the cradle being movably connected to one another so that movement of the post relative to the cradle is adapted to effectuate adjustment of the tube relative to the excavation bottom.

2. The adjustable stake of claim 1 wherein the post and the tube cradle are an integral structure.

3. The adjustable stake of claim 1 wherein the cradle is moveable between locked and unlocked positions, the cradle being releasably engageable with the tube in a manner to support the tube in spaced-apart relation to the excavation bottom when the cradle is in the locked position.

4. The adjustable stake of claim 3 wherein the cradle is engageable with both the tube and the post in a manner to releasably and adjustably secure the tube relative to the post when the cradle is in the locked position, the tube being moveable relative to the post when the cradle is in the unlocked position.

5. The adjustable stake of claim 3 wherein the resilient member is configured for resilient engagement with an exterior surface of the tube when the cradle is in the locked position.

6. The adjustable stake of claim 5 wherein the resilient engagement of the cradle with the exterior surface of the tube is a releasable, snap-fit engagement.

7. The adjustable stake of claim 5 wherein the resilient member includes a hook portion configured for a releasable, snap-fit engagement of the cradle with the exterior surface of the tube when the cradle is in the locked position.

8. The adjustable stake of claim 1 wherein the post and the cradle are adjustably connected to one another so that the cradle can be linearly adjusted relative to the post.

9. The adjustable stake of claim 8 wherein the post and the cradle are connected to one another in a threaded engagement so that rotation of the post relative to the cradle effectuates linear advancement of the cradle relative to the post.

10. The adjustable stake of claim 9 wherein the cradle includes an internally threaded portion which mates with an externally threaded portion of the post.

11. The adjustable stake of claim 9 wherein the cradle is engageable with the tube to releasably lock the tube and cradle relative to one another so that rotation of the post relative to the cradle effectuates linear advancement of the both the cradle and the tube relative to the post and relative to the excavation bottom.

12. The adjustable stake of claim 5 wherein the cradle includes a sleeve which at least partially circumscribes the post.

13. The adjustable stake of claim 12 wherein the cradle includes a handle portion connecting the resilient member to the sleeve.

14. The adjustable stake of claim 13 wherein the resilient member is rigidly connected to the handle portion.

15. The adjustable stake of claim 12 wherein the resilient member is connected to the handle portion by a spring which permits the resilient member to move relative to the handle portion.

16. The adjustable stake of claim 15 wherein the spring is a coil spring.

17. An adjustable concrete form for retaining concrete poured about one side of the form, said form comprising:

at least one hollow tube having at least one drainage aperture providing the form with integral drainage; and an adjustable stake for adjustably supporting the tube in spaced-apart relation to an excavation bottom, the adjustable stake including:

a post having at least one slender end to facilitate driving the post partially into the excavation bottom; and a tube cradle including a resilient member configured for resilient engagement with the tube to thereby secure the tube relative to the post and to support the tube in spaced-apart relation to the excavation bottom, the post and the cradle being movably connected to one another so that movement of the post relative to the cradle is adapted to effectuate adjustment of the tube relative to the excavation bottom.

18. The adjustable concrete form of claim 17 wherein the tube has two preformed apertures in the tube exterior and wherein the post passes through the two preformed apertures.

19. The adjustable concrete form of claim 18 wherein the two preformed apertures are positioned on the tube so that the post passes through the two apertures and is driven into the excavation bottom substantially normal therewith.

20. The adjustable concrete form of claim 17 wherein the post and the tube cradle are an integral structure.

21. The adjustable concrete form of claim 17 wherein the resilient member is configured for resilient engagement with an exterior surface portion of the tube.

22. The adjustable concrete form of claim 21 wherein the resilient member includes a hook portion, the hook portion being configured to receive the exterior surface portion of the tube in a releasable, snap-fit engagement.

23. The adjustable concrete form of claim 17 wherein the post and the cradle are connected to one another in a threaded engagement so that rotational movement of the post relative to the cradle is translated into linear movement of the cradle and tube relative to the post.

24. The adjustable concrete form of claim 23 wherein the cradle is engageable with the tube to releasably retain the tube and cradle relative to one another.

25. A method of constructing a concrete form comprising the steps of:

excavating a concrete receiving area;

driving an adjustable stake partially into the excavation bottom, the adjustable stake including a slender post and a resilient tube cradle, the tube cradle and the post being movably connected to one another;

securing a tube to the adjustable stake by bringing the resilient tube cradle into resilient engagement with the tube so that the tube is supported in spaced-apart relation to the excavation bottom; and adjusting the tube relative to the excavation bottom to bring the tube substantially to grade by altering the relative relationship of the post and the cradle.

26. The method of claim 25 wherein the step of securing the tube to the adjustable stake includes the step of moving the cradle relative to the post and relative to the tube to bring the cradle into resilient engagement with an exterior surface of the tube.

27. The method of claim 25 wherein the post and the cradle are connected to one another in a threaded engagement, and wherein the step of altering the relative relationship of the post and the cradle includes the step of rotating the post relative to the cradle to effectuate linear advancement of the cradle relative to the post.

28. The method of claim 25 wherein the step of adjusting the tube relative to the excavation bottom follows the step of securing the tube to the adjustable stake.

* * * * *